United States Patent [19]

Eriksson

[11] Patent Number: 4,457,207

[45] Date of Patent: Jul. 3, 1984

[54] BARREL CHAMBER

[75] Inventor: Kjell Eriksson, Karlskoga, Sweden

[73] Assignee: Aktiebolaget Bofors, Bofors, Sweden

[21] Appl. No.: 359,622

[22] Filed: Mar. 18, 1982

[30] Foreign Application Priority Data

Mar. 25, 1981 [SE] Sweden ..... 8101896

[51] Int. Cl.[3] ..... F41F 17/02

[52] U.S. Cl. ..... 89/14 R; 102/526

[58] Field of Search ..... 42/76 R; 89/14 R; 102/524, 525, 526, 527

[56] References Cited

U.S. PATENT DOCUMENTS

| | | | |
|---|---|---|---|
| 1,201,935 | 10/1916 | Campbell | 102/525 |
| 1,552,864 | 9/1925 | Methlin . | |
| 2,925,014 | 2/1960 | Abramson | 42/76 R |

FOREIGN PATENT DOCUMENTS

| | | | |
|---|---|---|---|
| 67844 | 6/1940 | Czechoslovakia | 42/76 R |
| 931240 | 2/1948 | France . | |
| 310118 | 7/1933 | Italy | 102/524 |
| 14480 | of 1901 | United Kingdom . | |
| 292551 | 5/1929 | United Kingdom . | |
| 480562 | 2/1938 | United Kingdom . | |
| 592092 | 9/1947 | United Kingdom . | |
| 854516 | 11/1960 | United Kingdom . | |

*Primary Examiner*—Stephen C. Bentley

*Attorney, Agent, or Firm*—Pollock, Vande Sande & Priddy

[57] ABSTRACT

An improved gun barrel is disclosed in which the breech chamber has a length (B) and diameter ($D_2$) which are chosen relative to the axial spacing (a) between a forward guiding ring (8) and a rearward driving band (6) of the ammunition unit to be fired from the barrel and relative to the diameters ($d_1$ and $d_2$) of the guiding ring and driving band, so that the longitudinal axis of the ammunition unit and the bore of the barrel are substantially aligned before the forward guiding ring enters the rifled portion of the bore.

4 Claims, 2 Drawing Figures

FIG. I

BARREL CHAMBER

TECHNICAL FIELD

The present invention relates to a breech chamber for a gun barrel, the chamber being a new design, in which an ammunition unit can be moved in its longitudinal direction from the rear end of the chamber up to the bore of the barrel for ramming the driving band of the ammunition unit into position at the beginning of the rifled portion of the bore of the barrel, the chamber comprising two parts, an extended rear cavity and a front cavity. Various types of ammunition units may be used, for instance projectiles, shells or the like.

BACKGROUND ART

The breech chamber according to the present invention is primarily intended to be used in connection with ammunition units having separately housed charges. In such ammunition, the propellant charge is separated from the projectile, shell or the like during the ramming procedure. The ramming of the projectile, shell or the like as well as the propellant charge can be carried out automatically or by hand. Various types of bag charges with or without cartridge cases can be used.

When the projectile, shell or the like is rammed into the beginning of the rifled portion of the bore of the barrel, the driving band of the respective ammunition unit prevents the combustion gases from the propellant charge from spreading into the bore of the barrel. The driving band is made of a comparatively soft material, such as copper, plastic, iron or the like. During ramming it is important that approximately the same ramming force can be achieved under different ramming conditions, in order to limit the variation of the muzzle velocity for different projectiles and for different firing elevations. Also, when firing in the most elevated position, the ramming force must be sufficient to ensure that the rammed ammunition unit does not fall backwards. Different muzzle velocities always mean a reduced hit probability.

In order to attain a more exact ramming, efforts have previously been concentrated on the ammunition and not so much on the design of the breech chamber.

DISCLOSURE OF THE INVENTION

Technical Problem

For the previously known designs of ammunition units with separately housed charges and the corresponding breech chambers, there is a great variation of the retaining forces for projectiles rammed into the beginning of the rifled portion. For 15.5 cm calibre ammunition, the retaining force varies for instance between 0 and 20 tons. When this problem was studied in connection with the present invention, it was noticed that there is a great risk of a so-called "drawer effect", that is, the ammunition unit may become squeezed in an inclined or cocked position when entering into the bore of the barrel. Thus "drawer effect" gives rise to the great variation of the retaining forces.

Solution

The main object of the present invention is to create such a new design of the breech chamber so that this problem can be solved and which then means that the variation of the retaining forces for the rammed projectile, shell or the like can be practically eliminated. According to the invention the internal shape of the front cavity is substantially cylindrical or slightly conical, expanding backwards. The front cavity also has such a diameter and length with respect to guiding means on the ammunition unit that the ammunition unit, when moved along the bottom of the chamber, or moved in any other way eccentrically in the chamber, is guided up before the guiding means of the ammunition unit have entered into the rifled bore of the barrel. This guiding up of the ammunition unit causes the longitudinal axis of the ammunition unit to coincide substantially with the bore axis.

Specifically the front cavity has such a diameter with respect to the driving band of the ammunition unit that the driving band, when passing the front cylindrical or slightly conical cavity, serves as a first guiding means which achieves the guiding up of the ammunition unit before a second guiding means of the ammunition unit in the form of a front guiding ring, enters the bore of the barrel. In other words, the length and diameter of the breech chamber are chosen relative to the geometry of the ammunition unit, so that together this length and diameter form a means for guiding the ammunition unit during ramming thereof into the breech chamber. The driving band is caused to enter the forward cavity of the breech chamber so that it moves the longitudinal axis of the ammunition unit into substantial coincidence with the longitudinal axis of the bore, before the guiding ring enters the rifled portion of the bore. Further embodiments of the invention relate to the specific design and dimensions of the breech chamber and the adjacent part of the bore of the barrel with respect to the in use ammunition.

Advantages

Thanks to the aforementioned specific design of the chamber, the undesired drawer effect can be avoided when the projectile, shell or the like moves along the bottom of the chamber. The wall of the front cavity lifts the rear end of the projectile, shell or the like via its driving band or corresponding guiding means. As a result, the longitudinal axis of the ammunition unit substantially coincides with the bore axis before the front guiding means of the ammunition unit, which has a diameter substantially corresponding to the diameter of the bore of the barrel, enters the bore of the barrel. It has been proved by experiments that the retaining forces for one type of ammunition unit used with this new chamber design are about 20 tons, with a very small variation only. These experiments have also proved that the new chamber design really is superior to the previously known chamber designs having front cavity diameters significantly larger than the diameter of the driving band of the ammunition unit in use.

BRIEF DESCRIPTION OF THE DRAWINGS

An embodiment having the characteristics significant for the invention will now be described with reference to the attached drawings, in which.

BEST MODE FOR CARRYING OUT THE INVENTION

Figure 1:
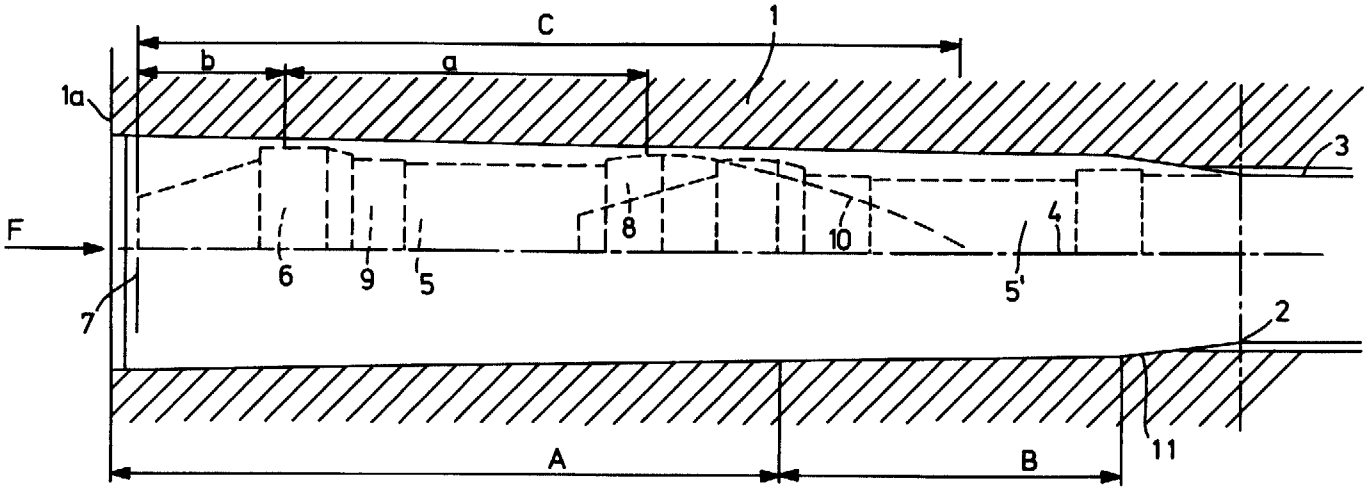
FIG. 1 is a longitudinal sectional view of a breech chamber.

FIG. 1 shows the rear portion 1 of a barrel, for instance the barrel of a rapid fire gun. The breech chamber is arranged in the rear portion of the barrel. The breech chamber comprises a rear cavity A and a front cavity B. The rear cavity has a length which is approximately twice the length of the front cavity B. Figure 1 also shows the beginning 2 of the rifled portion of the bore 3 of the barrel. The bore axis is indicated by 4. Both the front and rear cavities have smooth, unrifled walls.

An ammunition unit having a body and a longitudinal axis 5 is intended to be moved in the longitudinal direction of the breech chamber. The ramming force 1 for moving this ammunition unit, can be achieved automatically or by hand, both methods being known per se. The object of the ramming procedure for the ammunition unit, for instance in the form of a projectile, shell or the like, is to move the ammunition unit from the ammunition handling means behind the barrel to a rammed position at the beginning 2 of the rifled portion of the bore 3. In this rammed position, the projectile is squeezed into the rifling by means of a radially extending driving band 6 of the ammunition unit, which driving band as a rule is located at the rear part of the ammunition unit. Figure 1 shows the ammunition unit in two different longitudinal positions, a first position 5 and a second position 5'. A separate charge is located behind the ammunition unit (but not illustrated here) and the breech chamber is closed by means of a screw mechanism or any other closing mechanism (but not illustrated here) at the rear surface 1*a* of the barrel. When the charge, or charges, located behind the ammunition unit are initiated, powder gases are developed which serve as propellant means for the ammunition unit, so that the ammunition unit is forced out through the bore of the barrel. The propellant gases are primarily intended to act on the rear surface 7 of the ammunition unit. Thus, the tightening between the driving band and the rifling must be so efficient that the powder gases are prevented from leaking out between the ammunition unit and the wall of the bore. Such leaking would give rise to the previously mentioned variation or spreading effect of the muzzle velocities of the ammunition units. The ammunition unit illustrated here also comprises guiding means in the form of a front guiding ring 8 and a rear, second guiding ring 9 and a nose portion 10. Such a design of the ammunition unit is previously known and will not be described in detail here.

The front cavity B is substantially cylindrical or slightly conical, expanding backwards and with a conicity of 1:300–1:1000. At its front end front cavity B converges into a comparatively short conical surface 11 connecting the front cavity with the beginning 2 of the rifling. The total length of conical surface 11 is approximately 10–20% of the length of the front cavity. For a 15.5 cm calibre ammunition unit the tolerance between the diameter of the front cavity, in the cylindrical or slightly conical case the smallest diameter, and the diameters of the front guiding ring 8 as well as the rear guiding ring 9, is approximately 3–5 mm. The corresponding tolerances between the front cavity and the driving band 6 of the ammunition unit is between 0.2 and 2.5 mm. Thus, the diameter of band 6 is significantly larger than that of ring 8. The tolerance between the bore 3 of the barrel and the guiding rings is between 0.02 and 0.03 mm; so that, as mentioned previously, the diameter of the guiding rings 8, 9 substantially corresponds to that of bore 3.

The length B of the front cavity compared with the length a between the driving band 6, which serves as first guiding means, and the front guiding ring 8, which serves as second guiding means for the ammunition unit, is important in this invention. The length B of the front cavity must exceed or be substantially equal to the length a so that the ammunition unit is guided up via its driving band 6 into the front cavity B before the front guiding ring 8 enters the cylindrical bore 3 of the barrel.

In FIG. 1 the length b between the rear surface 7 and the driving band 6 is indicated. The total length of the projectile is indicated by c, in this case approximately 700 mm.

The rear cavity A is conical and flares or expands from the rear part of the front cavity B to the rear end surface 1*a* of the rear portion 1 of the barrel. The conicity of the rear cavity A is in this case approximately 1:25, but may be varied substantially within the scope of this invention. The rear cavity A may also comprise a number of conicities and even be partially cylindrical. The end surface 1*a*, however, must be provided with such an opening to the rear cavity A so that the ammunition units can be appropriately inserted into the chamber of the barrel.

Figure 2:
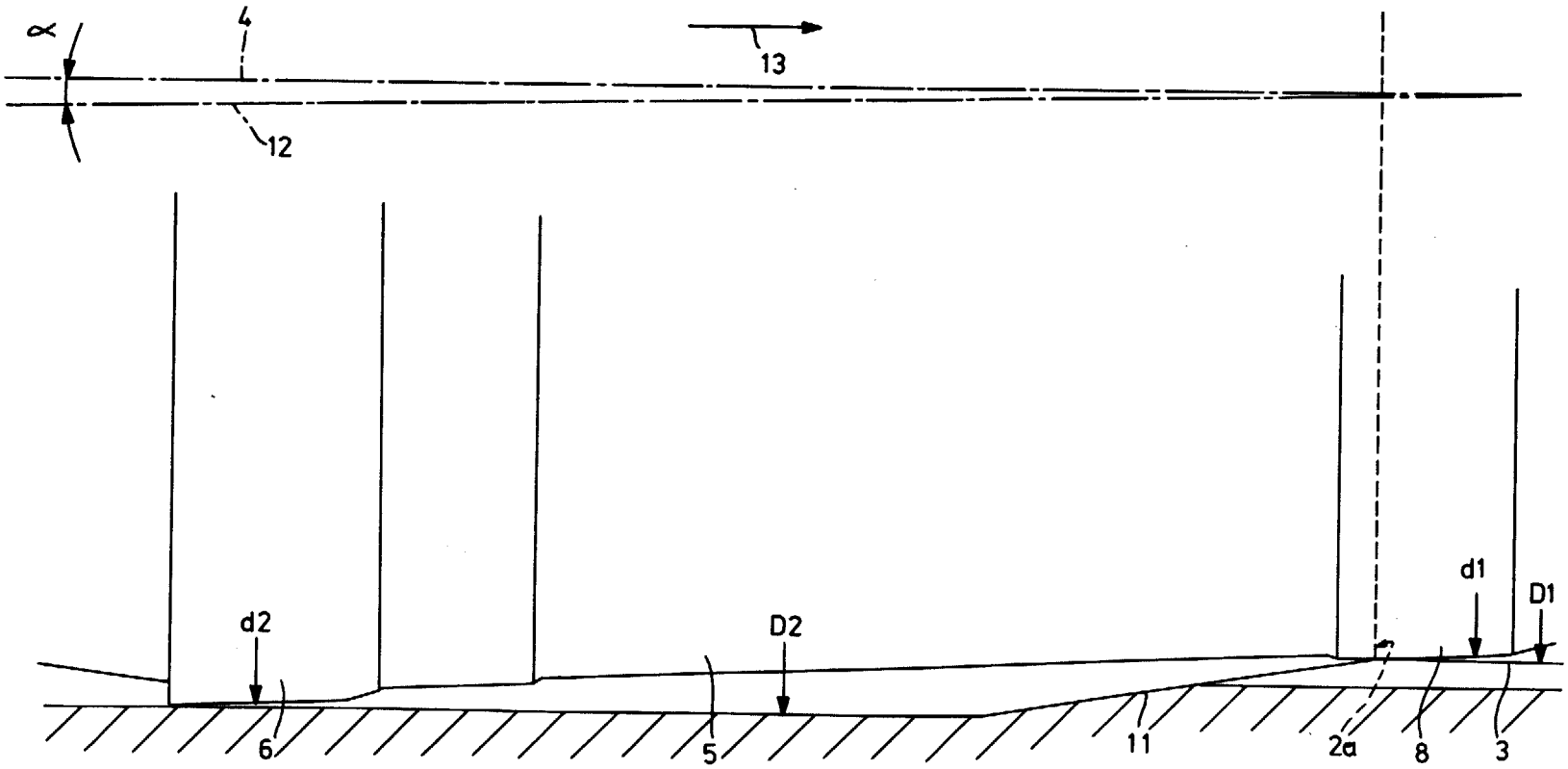
FIG. 2 is an enlarged sectional view of specific portions of the breech chamber of FIG. 1.

In FIG. 1 the ammunition unit is indicated in a free flight-position in the rear cavity A. It is also possible, however, to permit the ammunition unit to slide along the bottom of the rear cavity A. FIG. 2 shows an enlarged view of the critical position of the ammunition unit 5 during the ramming operation. FIG. 2 is intended to illustrate the maximal inclined position of the ammunition unit in the form of a projectile located rammed into the bore 3 of the barrel. In such an inclined position there is an angle $\alpha$ between the bore axis 4 and the longitudinal axis 12 of the projectile. According to the invention, substantial coincidence is achieved between these axes since the angle is between 0° and 1.0° for a 15.5 cm calibre ammunition unit. The arrow 13 indicates the forward direction and D1 the diameter of the bore of the barrel, d1 the diameter of the front guiding ring 8 of the projectile, D2 the diameter of the front cavity B of the chamber and d2 the diameter of the driving band 6 of the projectile.

Due to the length of the front guiding ring 8, it has previously occurred that such an inclined projectile position has prevented the projectile from being further inserted in the bore of the barrel. This has happened for a specific relation between the diameter of the bore 3 and the diameter of the guiding ring 8. For a satisfactory guiding of the projectile through the bore of the barrel at firing, the diameters of the front as well as the rear guiding rings must be substantially the same as the bore diameter, for a 15.5 cm calibre ammunition, as already mentioned, only a difference of about 0.02–0.03 mm. As furthermore the front guiding ring must have a certain length for a satisfactory guiding in the bore, it is realized that there is a geometrical relationship between the following quantities:

outer diameter of the driving band;
inner diameter of the front cavity;
outer diameter of the front guiding ring;
bore diameter;
length between the front guiding ring and the driving band;
length of the front guiding ring.

Depending on which of said quantities are given at the construction of a weapon system, the other quantities are determined mathematically. If for instance the difference between the bore diameter and the outer diameter of the front guiding ring is small, then the front cavity must have a small diameter difference with respect to the driving band. If also the front guiding ring is long, then said requirements are even more accentuated.

When using projectiles from different manufacturers in the same barrel, it can be difficult to satisfy this mathematical relationship and interruptions in the ramming procedure may occur. For instance 15.5 cm calibre projectiles may have different driving band diameters and also different lengths of the front guiding rings. Then the diameter of the front cavity must be determined with respect to the projectiles having the largest driving band diameter, and the front cavity diameter is then made to slightly exceed the driving band diameter. When projectiles having smaller driving band diameters or smaller guiding ring lengths are used it is realized that problems may arise as the mathematical relationship is not satisfied.

In such cases a further embodiment of our invention can be used, which embodiment comprises a slightly widened bore of the barrel from the beginning of the rifling and forwards a distance corresponding to the distance between the front guiding ring and the driving band of the ammunition unit. The widened bore part can be calculated by means of the mathematical relationship in which case the bore diameter is the unknown variable. For a 15.5 cm calibre projectile for instance, the bore is widened about 0.1–0.5 mm and the widened bore part may be cylindrical or slightly conical.

The invention is not limited to these embodiments but can be varied within the scope of the following claims. It should be pointed out here that the previously mentioned tolerances are related to a 15.5 cm calibre ammunition unit. For other calibres the tolerances may be changed, of course. It has also been mentioned that the ammunition unit can be moved along the bottom of the chamber during the ramming procedure. Of course, also other eccentric positions of the ammunition unit with respect to the bore axis may occur.

INDUSTRIAL APPLICABILITY

The improved barrel chamber may be used for instance on a rapid fire gun and is comparatively easy to manufacture at modern gun factories.

I claim:

1. An improved gun barrel for use with ammunition units of the type having a body with a first longitudinal axis, a rearward driving band of diameter $d_2$ extending radially outwardly from the body and a forward guiding ring of diameter $d_1$ less than $d_2$ spaced axially forward a distance a from said driving band, said barrel comprising:

an elongated body:

a bore within said body, said bore having a second longitudinal axis, said bore comprising a forward, rifled portion with a diameter $D_1$ and a rearward breech chamber, said breech chamber comprising a rear cavity and a forward cavity opening from said rear cavity toward said rifled portion, said forward cavity having an axial length B at least substantially equal to the distance a between the rearward driving band and the forward guiding ring of the ammunition unit and a diameter $D_2$ greater than said diameter $D_1$ of said rifled portion and greater than the diameters $d_1$ and $d_2$ of the forward guiding ring and the rearward driving band of the ammunition unit, said length B and said diameter $D_2$ of said forward cavity thereby forming means for guiding the ammunition unit during ramming thereof into said breech chamber by causing said driving band to enter said forward cavity and engage said diameter $D_2$ to move the first longitudinal axis of the ammunition unit into substantial coincidence with said second longitudinal axis of said bore, before said forward guiding ring enters said rifled portion.

2. A barrel according to claim 1, wherein said diameter $D_1$ of said rifled portion substantially corresponds to the diameter $d_1$ of the forward guiding ring of the ammunition unit.

3. A barrel according to claim 1 of 2 wherein said rifled portion is enlarged radially over an axial distance corresponding to said distance a, said axial distance extending forward from the beginning of said rifled portion.

4. A barrel according to claim 1, further comprising a rearwardly flaring conical portion in said bore between said rifled portion and said forward cavity, said conical portion having an axial length in the range of 0.10B to 0.20B.

* * * * *